US006649873B1

(12) United States Patent
Cintron, Jr. et al.

(10) Patent No.: US 6,649,873 B1
(45) Date of Patent: Nov. 18, 2003

(54) TEMPERATURE-CONTROLLED HEATED GARMENT

(76) Inventors: Jose Cintron, Jr., 11921 Plantation Rd., Fort Myers, FL (US) 33912; Carmen M. Cintron, 11921 Plantation Rd., Fort Myers, FL (US) 33912

( * ) Notice: Subject to any disclaimer, the term of this patent is extended or adjusted under 35 U.S.C. 154(b) by 8 days.

(21) Appl. No.: 10/076,466

(22) Filed: Feb. 15, 2002

(51) Int. Cl.[7] ..... H05B 1/00
(52) U.S. Cl. ..... 219/211; 219/527
(58) Field of Search ..... 219/211, 527, 219/528, 529, 549, 212, 217; 601/15, 18

(56) References Cited

U.S. PATENT DOCUMENTS 4,404,460 A 9/1983 Kerr
5,148,002 A 9/1992 Kuo et al.
5,893,991 A * 4/1999 Newell ..... 219/211
5,977,517 A 11/1999 Grosjean
6,005,222 A 12/1999 Hicks
6,049,062 A 4/2000 Jones
D429,058 S 8/2000 Derosier
6,329,638 B1 * 12/2001 Bloodworth ..... 219/211

* cited by examiner

*Primary Examiner*—Tu Ba Hoang

(57) ABSTRACT

A temperature-controlled heated garment for providing heat to the torso of the user when needed. The temperature-controlled heated garment includes a garment member having multiple layers of material and also having at least one heating element connection outlet and being adapted to be worn about a torso of a user; and also includes heating elements being disposed between the multiple layers of material and throughout the garment member and being connected to the at least one heating element connection outlet; and further includes a heat-producing assembly including a housing member being connected to the at least one heating element connection outlet and being fastenable with fasteners to the garment.

5 Claims, 2 Drawing Sheets

TEMPERATURE-CONTROLLED HEATED GARMENT

BACKGROUND OF THE INVENTION

1. Field of the Invention

The present invention relates to heated garments and more particularly pertains to a new temperature-controlled heated garment for providing heat to the torso of the user when needed.

2. Description of the Prior Art

The use of heated garments is known in the prior art. More specifically, heated garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,148,002; U.S. Pat. No. 4,404,460; U.S. Pat. No. 6,049,062; U.S. Pat. No. 6,005,222; U.S. Pat. No. 5,977,517; and U.S. Pat. No. Des. 429,058.

While these devices fulfill their respective, particular objectives and requirements, the aforementioned patents do not disclose a new temperature-controlled heated garment. The inventive device includes a garment member having multiple layers of material and also having at least one heating element connection outlet and being adapted to be worn about a torso of a user; and also includes heating elements being disposed between the multiple layers of material and throughout the garment member and being connected to the at least one heating element connection outlet; and further includes a heat-producing assembly including a housing member being connected to the at least one heating element connection outlet and being fastenable with fasteners to the garment.

In these respects, the temperature-controlled heated garment according to the present invention substantially departs from the conventional concepts and designs of the prior art, and in so doing provides an apparatus primarily developed for the purpose of providing heat to the torso of the user when needed.

SUMMARY OF THE INVENTION

In view of the foregoing disadvantages inherent in the known types of heated garments now present in the prior art, the present invention provides a new temperature-controlled heated garment construction wherein the same can be utilized for providing heat to the torso of the user when needed.

The general purpose of the present invention, which will be described subsequently in greater detail, is to provide a new temperature-controlled heated garment apparatus and method which has many of the advantages of the heated garments mentioned heretofore and many novel features that result in a new temperature-controlled heated garment which is not anticipated, rendered obvious, suggested, or even implied by any of the prior art heated garments, either alone or in any combination thereof.

To attain this, the present invention generally comprises a garment member having multiple layers of material and also having at least one heating element connection outlet and being adapted to be worn about a torso of a user; and also includes heating elements being disposed between the multiple layers of material and throughout the garment member and being connected to the at least one heating element connection outlet; and further includes a heat-producing assembly including a housing member being connected to the at least one heating element connection outlet and being fastenable with fasteners to the garment.

There has thus been outlined rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new temperature-controlled heated garment apparatus and method which has many of the advantages of the heated garments mentioned heretofore and many novel features that result in a new temperature-controlled heated garment which is not anticipated, rendered obvious, suggested, or even implied by any of the prior art heated garments, either alone or in any combination thereof.

It is another object of the present invention to provide a new temperature-controlled heated garment which may be easily and efficiently manufactured and marketed.

It is a further object of the present invention to provide a new temperature-controlled heated garment which is of a durable and reliable construction.

An even further object of the present invention is to provide a new temperature-controlled heated garment which is susceptible of a low cost of manufacture with regard to both materials and labor, and which accordingly is then susceptible of low prices of sale to the consuming public, thereby making such temperature-controlled heated garment economically available to the buying public.

Still yet another object of the present invention is to provide a new temperature-controlled heated garment which provides in the apparatuses and methods of the prior art some of the advantages thereof, while simultaneously overcoming some of the disadvantages normally associated therewith.

Still another object of the present invention is to provide a new temperature-controlled heated garment for providing heat to the torso of the user when needed.

Yet another object of the present invention is to provide a new temperature-controlled heated garment which includes a garment member having multiple layers of material and also having at least one heating element connection outlet and being adapted to be worn about a torso of a user; and also includes heating elements being disposed between the multiple layers of material and throughout the garment member and being connected to the at least one heating element connection outlet; and further includes a heat-producing assembly including a housing member being connected to the at least one heating element connection outlet and being fastenable with fasteners to the garment.

Still yet another object of the present invention is to provide a new temperature-controlled heated garment that is easy and convenient to use.

Even still another object of the present invention is to provide a new temperature-controlled heated garment that eliminates the user having to put on layers of clothes to keep warm which often tends to be somewhat futile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
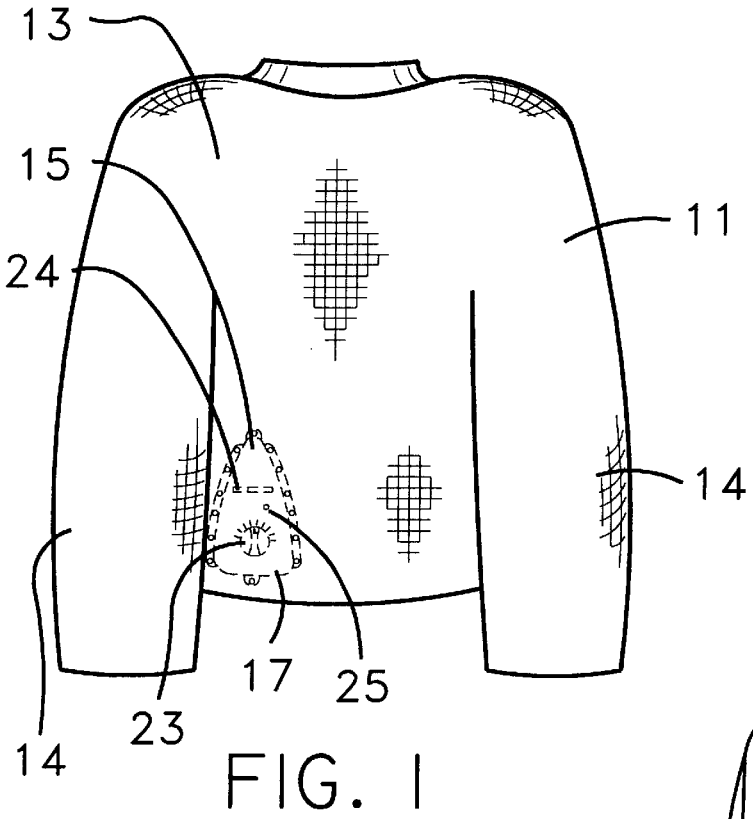
FIG. 1 is a rear elevational view of a new temperature-controlled heated garment according to the present invention.
Figure 2:
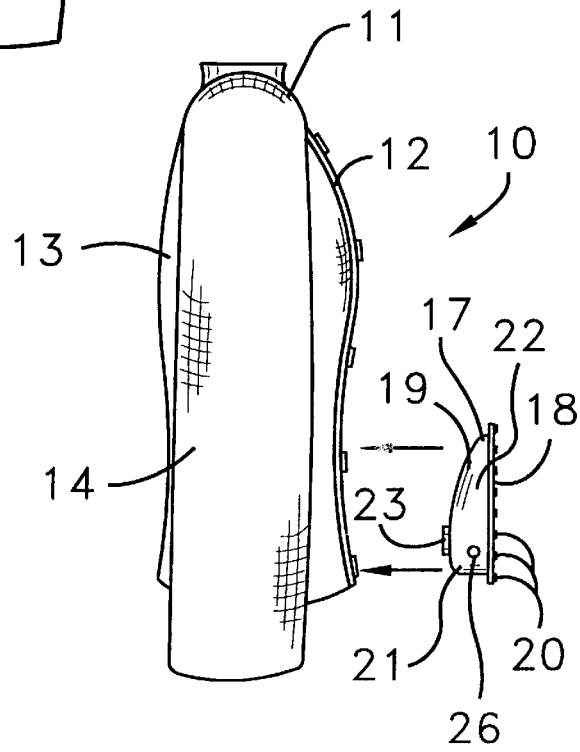
FIG. 2 is a side elevational view of the present invention.
Figure 3:
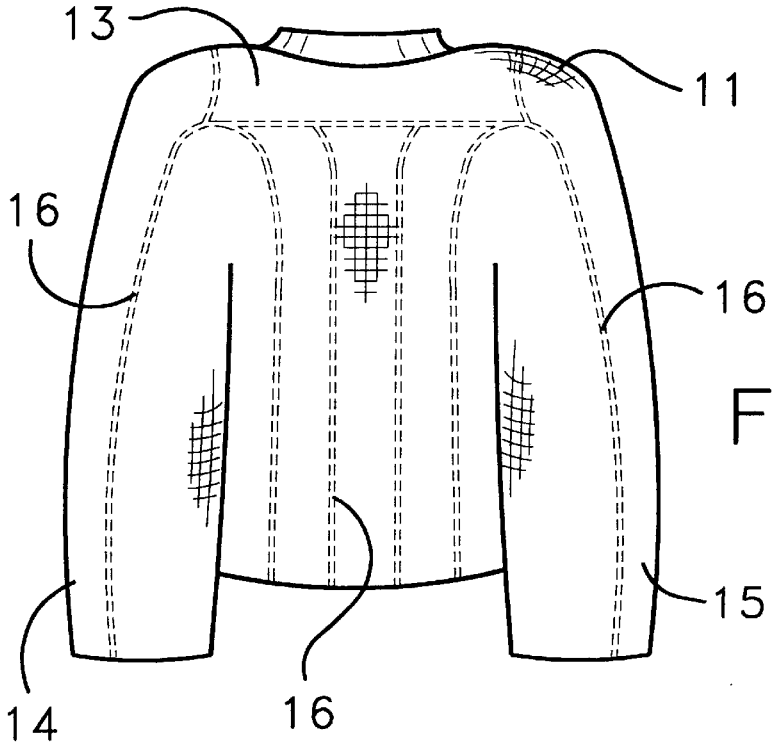
FIG. 3 is another rear elevational view of the present invention.
Figure 4:
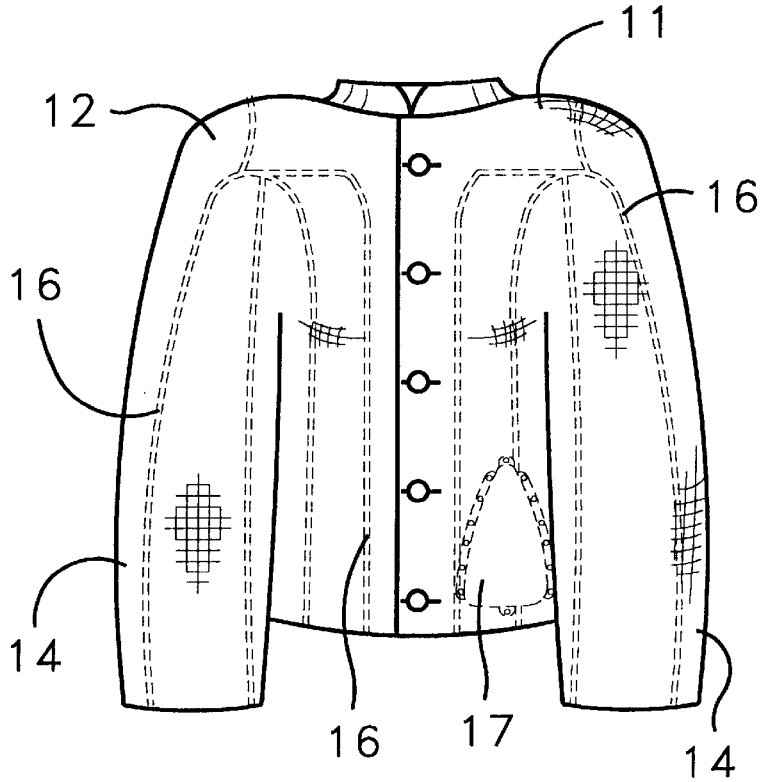
FIG. 4 is a front elevational view of the present invention.

With reference now to the drawings, and in particular to FIGS. 1 through 4 thereof, a new temperature-controlled heated garment embodying the principles and concepts of the present invention and generally designated by the reference numeral 10 will be described.

As best illustrated in FIGS. 1 through 4, the temperature-controlled heated garment 10 generally comprises a garment member 11 having multiple layers of material and also having at least one heating element connection outlet 15 being conventionally disposed therein with the garment member 11 being adapted to be worn about a torso of a user. Heating elements 16 are disposed between the multiple layers of material and throughout the garment member 11 and are conventionally connected to the at least one heating element connection outlet 15. The heating elements 16 are disposed throughout a back side 13, a front side 12, and sleeves 14 of the garment member 11.

A heat-producing assembly includes a housing member 17 being conventionally connected to the at least one heating element connection outlet 15 and being fastenable with fasteners 20 to the garment member 11. The housing member 17 includes a back wall 18 and a front panel 19. The heat-producing assembly further includes a battery pack 21 being removably disposed in the housing member 17, and also includes a temperature-controllable switch member 23 being movably and conventionally attached upon the front panel 19 of the housing member 17 and being conventionally connected to the battery pack 21 for controlling the temperature of the heating elements 16, and further includes a power cord jack 26 being conventionally disposed in the front panel 19 of the housing member 17 and being conventionally connected to the battery pack 21 for allowing a power cord to be connected to the battery pack 21 for recharging the battery pack 21. The heat-producing assembly also includes a conventional battery power level indicator 24 being conventionally disposed upon the housing member 17 and being conventionally connected to the battery pack 21, and also includes a conventional pre-set temperature sensor 22 being conventionally disposed in the housing member 17, and further includes a conventional alarm-signaling indicator 25 being conventionally disposed upon the housing member 17 and being conventionally connected to the pre-set temperature sensor 22 for warning of excessive heat being produced. The fasteners 20 are conventionally attached upon the back wall 18 of the housing member 17.

In use, the user attaches the housing member 17 to the heating element connection outlet 15, and turns on the temperature-controllable switch member 23 to energize the battery pack 21 which causes the heating elements 16 to heat up and provide warmth and heat through the garment member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A temperature-controlled heated garment comprising:

a garment member having multiple layers of material and also having at least one heating element connection outlet and being adapted to be worn about a torso of a user;

heating elements being disposed between said multiple layers of material and throughout said garment member and being connected to said at least one heating element connection outlet; and a heat-producing assembly including a housing member being connected to said at least one heating element connection outlet;

wherein said housing member includes a back wall and a front panel;

wherein said heat-producing assembly further includes a battery pack being removably disposed in said housing member, and also includes a temperature-controllable switch member being movably attached upon said front panel of said housing member and being connected to said battery pack for controlling the temperature of said heating elements, and further includes a power cord jack being disposed in said front panel of said housing member and being connected to said battery pack for allowing a power cord to be connected to said battery pack for recharging said battery pack; and a plurality of fasteners coupled around a perimeter of said back wall of said housing member, said fasteners being couplable to said garment member such that said back wall of said housing is positioned substantially flush with an exterior surface of said garment member when said housing is coupled to said garment member.

2. A temperature-controlled heated garment as described in claim 1, wherein said heating elements are disposed throughout a back side, a front side, and sleeves of said garment member.

3. A temperature-controlled heated garment as described in claim 1, wherein said heat-producing assembly also includes a battery power level indicator being disposed upon said housing member and being connected to said battery pack, and also includes a pre-set temperature sensor being disposed in said housing member, and further includes an alarm-signaling indicator being disposed upon said housing member and being connected to said pre-set temperature sensor for warning of excessive heat being produced.

4. A temperature-controlled heated garment as described in claim 1, wherein said fasteners are attached upon said back wall of said housing member.

5. A temperature-controlled heated garment comprising:

a garment member having multiple layers of material and also having at least one heating element connection outlet and being adapted to be worn about a torso of a user;

heating elements being disposed between said multiple layers of material and throughout said garment member and being connected to said at least one heating element connection outlet, said heating elements being disposed throughout a back side, a front side, and sleeves of said garment member;

a heat-producing assembly including a housing member being connected to said at least one heating element connection outlet, said housing member including a back wall and a front panel, said heat-producing assembly further including a battery pack being removably disposed in said housing member, and also including a temperature-controllable switch member being movably attached upon said front panel of said housing member and being connected to said battery pack for controlling the temperature of said heating elements, and further including a power cord jack being disposed in said front panel of said housing member and being connected to said battery pack for allowing a power cord to be connected to said battery pack for recharging said battery pack, said heat-producing assembly also including a battery power level indicator being disposed upon said housing member and being connected to said battery pack, and also including a pre-set temperature sensor being disposed in said housing member, and further including an alarm-signaling indicator being disposed upon said housing member and being connected to said pre-set temperature sensor for warning of excessive heat being produced [said fasteners being attached upon said back wall of said housing member]; and a plurality of fasteners coupled around a perimeter of said back wall of said housing, said fasteners being couplable to said garment member such that said back wall of said housing is positioned substantially flush with an exterior surface of said garment member when said housing is coupled to said garment member.

* * * * *